US010625172B2

(12) United States Patent
Mak

(10) Patent No.: US 10,625,172 B2
(45) Date of Patent: Apr. 21, 2020

(54) SPINNING TOY

(71) Applicant: Bumblebee Studio Limited, Quarry Bay (HK)

(72) Inventor: Yuen Pik Pandora Mak, Quarry Bay (HK)

(73) Assignee: Bumblebee Studio Limited, Quarry Bay (HK)

( * ) Notice: Subject to any disclaimer, the term of this patent is extended or adjusted under 35 U.S.C. 154(b) by 0 days.

(21) Appl. No.: 16/010,088

(22) Filed: Jun. 15, 2018

(65) Prior Publication Data

US 2019/0015757 A1 Jan. 17, 2019

(30) Foreign Application Priority Data

Jul. 14, 2017 (HK) ..... 17107107.6

(51) Int. Cl.
*A63H 29/08* (2006.01)
*A63H 1/00* (2019.01)
*A63H 33/00* (2006.01)

(52) U.S. Cl.
CPC ..... *A63H 29/08* (2013.01); *A63H 1/00* (2013.01); *A63H 33/00* (2013.01)

(58) Field of Classification Search
CPC ..... A63H 1/00; A63H 29/08; A63H 33/00; A63B 2208/12
USPC ..... 446/233, 236, 250, 256; 473/569, 588
See application file for complete search history.

(56) References Cited

U.S. PATENT DOCUMENTS 547,764 A * 10/1895 Boyum ..... A63F 9/16 446/256
5,591,062 A * 1/1997 Hettinger ..... A63B 67/086 446/240
6,364,734 B1 * 4/2002 Ng ..... A63H 1/00 446/236
7,361,075 B1 * 4/2008 Krull ..... A63B 23/16 446/491
9,895,620 B1 * 2/2018 Walterscheid ..... A63H 1/24
9,914,063 B1 * 3/2018 McCoskery ..... A63H 29/08
10,016,693 B1 * 7/2018 Dowdy ..... A63H 33/003
10,406,450 B2 * 9/2019 Howard ..... A63H 17/264
2017/0326468 A1 * 11/2017 Kinmont, Jr. ..... A63H 33/067
2018/0342930 A1 * 11/2018 Roberts ..... H02K 7/1853
2018/0344003 A1 * 12/2018 Fogelson ..... A45D 40/24
2018/0345155 A1 * 12/2018 Philgreen ..... A63H 1/00
2018/0345156 A1 * 12/2018 Bornstein ..... A63H 1/00
2018/0352829 A1 * 12/2018 Diamond ..... A23G 3/563
(Continued)

*Primary Examiner* — Alexander R Niconovich
(74) *Attorney, Agent, or Firm* — Muncy, Geissler, Olds & Lowe, P.C.

(57) ABSTRACT

A spinning toy includes a main body provided with blades, each of which can be provided with weight modules. The weight modules are provided with counter-weight members, of which the positions are adjustable. A bearing having an upper finger cover and a bottom finger cover is mounted in the center of the main body. By pinching the two finger covers via fingers, a user can hold the toy and suspend the main body between the fingers, and then slightly flick the blades with the other hand to enable the blades to spin; when the positions of the counter-weight members of the weight modules are adjusted, as the gravity center is no longer evenly distributed, the user can make the blades spin for a long time by swinging the toy in a proper rhythm.

11 Claims, 4 Drawing Sheets

(56) References Cited

U.S. PATENT DOCUMENTS

2018/0353868 A1* 12/2018 Albert ..... A63H 1/00
2018/0369703 A1* 12/2018 Sorias ..... A63H 33/00

* cited by examiner

SPINNING TOY

TECHNICAL FIELD

The present invention relates to the field of games, and more particularly relates to a toy which is flicked with fingers to spin and can maintain spinning for a long time.

BACKGROUND ART

Conventional finger-actuated small toys available on the market generally have two- to three- (or multiple) pronged design, with a bearing mounted on a small round plate disposed in the center of each small toy. When holding the center round plate, a person can spin the toy. However, the conventional finger-actuated small toy may only keep spinning for a short period of time, and no matter how hard a player flicks a rotator, it is still unable to spin for a long time. Therefore, a player has to frequently do finger actions to maintain a required long-time spin. Apparently, the frequent actions to initiate spin would often disturb the player, resulting in spin becoming disappointing and dispiriting.

Therefore, there is urgent need of an improved hand-actuated toy which may be easily span for a long time, and the balance weight of which may also be adjusted as required to change the spinning time of the toy to improve the interestingness and the playability of the toy.

SUMMARY OF THE INVENTION

The present invention aims at solving the above-mentioned technical problem and providing a balance weight-adjustable toy. By adjustment of the balance weight and with the help of swinging in a proper rhythm, the toy may spin for a long time, thereby improving the interestingness and the playability of the toy.

Therefore, to achieve the above-mentioned objective, the present invention adopts the following technical solution:

a spinning toy comprising:

a main body, which is made of light-weight materials, wherein the main body is provided with blades, and each blade can be provided with weight modules which are provided with counter-weight members, of which the positions are adjustable;

a bearing, which is disposed in the center of the main body;

an upper finger cover and a bottom finger cover is disposed to the upper part and bottom part of the bearing respectively, wherein by pinching the two finger covers via fingers, a user can hold the toy and suspend the main body between the fingers; and the weight modules, which are disposed on the blades to balance the weight of the spinning toy, wherein at least one weight module may be moved to adjust the twisting force to change the momentums of the blades;

In a spinning toy according to the present invention, the weight modules are disposed at the end parts of the blades. Preferably, the blades are provided with different fixing positions for the weight modules to be fixed at.

Further, the weight modules can be metal balls or any accessories having proper weights.

In a spinning toy according to the present invention, the bearing is pre-disposed on the body, and the upper and bottom finger covers are buttoned on the bearing.

According to one embodiment of the spinning toy of the present invention, the body is manufactured by integral molding of plastic material. Preferably, the plastic material is ABS (Acrylonitrile Butadiene Styrene).

According to one embodiment of the present invention, at least one blade of the main body includes a separable assembling piece for fixing the weight modules at adjustable positions. In addition, the assembling piece may be separated from the main body of the toy and then recombined with the main body so as to replace the weight module.

According to one embodiment of the spinning toy of the present invention, connection structures are disposed on the upper and bottom finger covers to enhance the connectivity of the toy to connect other spinning toys or other devices or tools.

Preferably, the connection structures are bulges or recesses disposed on the upper and bottom finger covers. For example, the bulges and the recesses can align with each other to combine multiple toys together.

The present invention may adjust distances between the counter-weight members on the blades and the center. A user swings the toy in a proper rhythm to make it spin for a long time, so that the shortcoming that long-time spin of the toy may not be realized in the prior art is overcome.

In addition, in a toy according to the present invention, the positions of the counter-weight members of the weight modules on the blades of the toy may be adjusted as required, and the user can increase the spinning speed by swinging the toy in different rhythms, thereby achieving the aim of autonomously controlling the spin, and improving the interestingness and the playability of the toy.

The connection structures further disposed on the toy of the present invention may allow multiple toys to be stacked together, or coordinated with and be connected to other devices to make the multiple toys spin together independently, thus greatly improving the playability of the whole toy.

BRIEF DESCRIPTION OF THE DRAWINGS

To describe and clarify the detailed structures of the present invention in further details, the following detailed description is given with reference to the accompanying drawings, in which.

DETAILED DESCRIPTION OF THE PRESENT INVENTION

A detailed elaboration and description will be made to the structure of a spinning toy of the present invention by way of the embodiments below.

Figure 1:
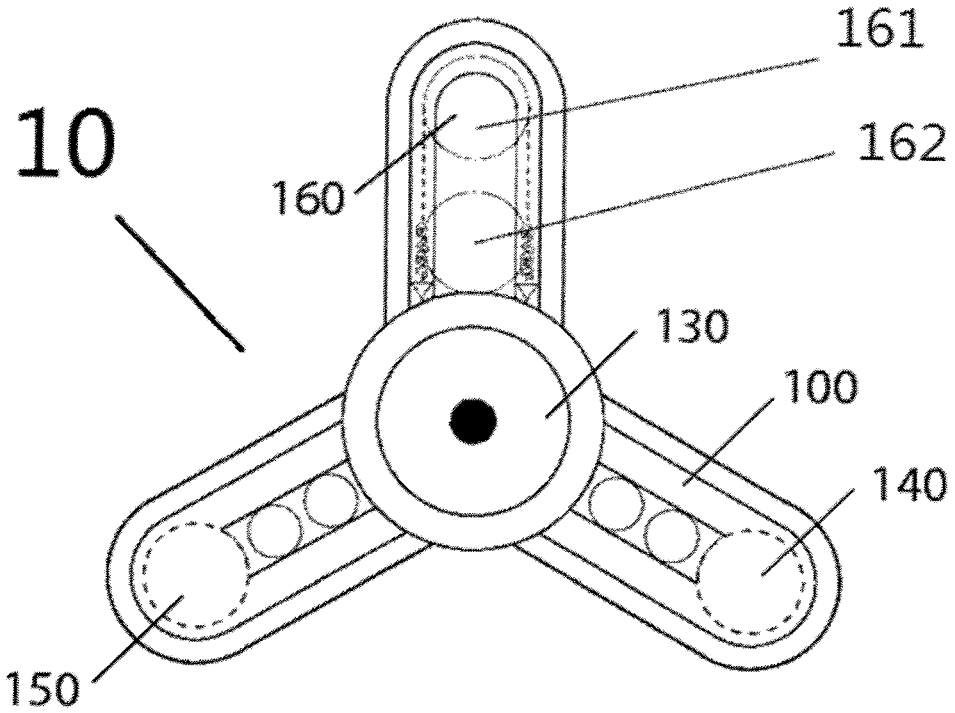
FIG. 1 is a top view of a spinning toy of the present invention.
Figure 2:
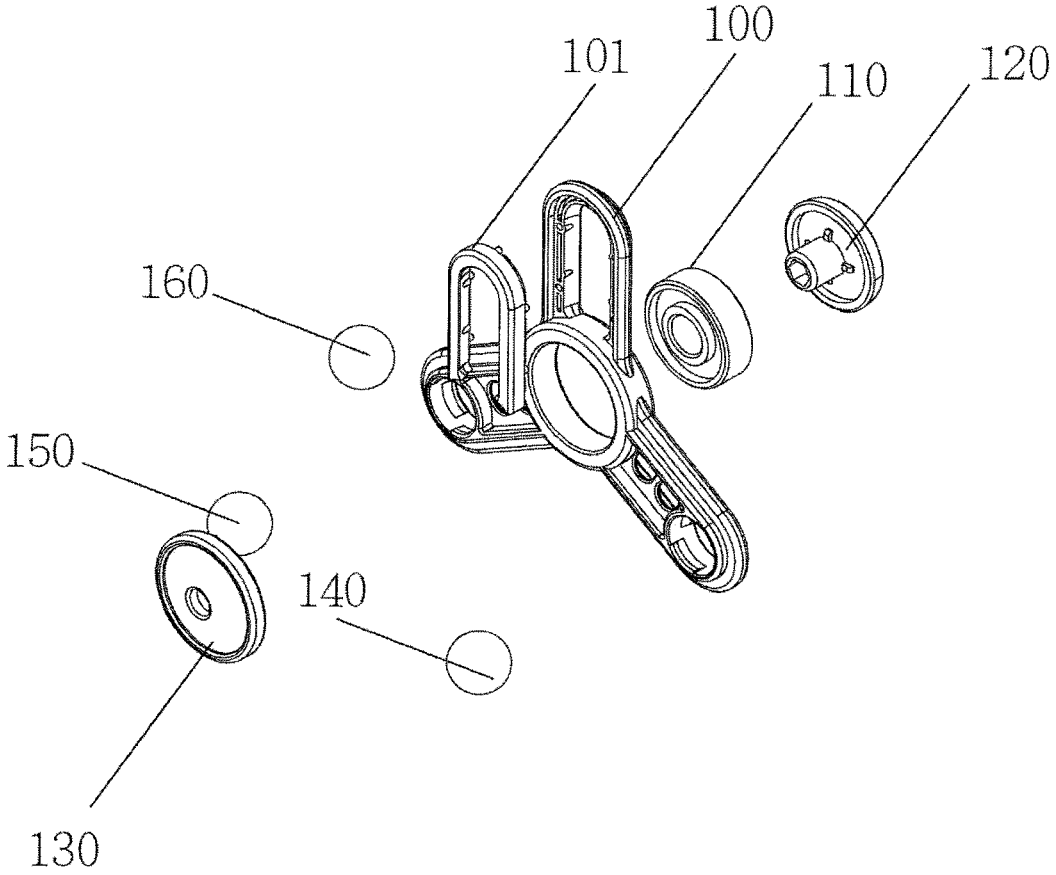
FIG. 2 is an exploded view of the spinning toy of the present invention.
Figure 3:
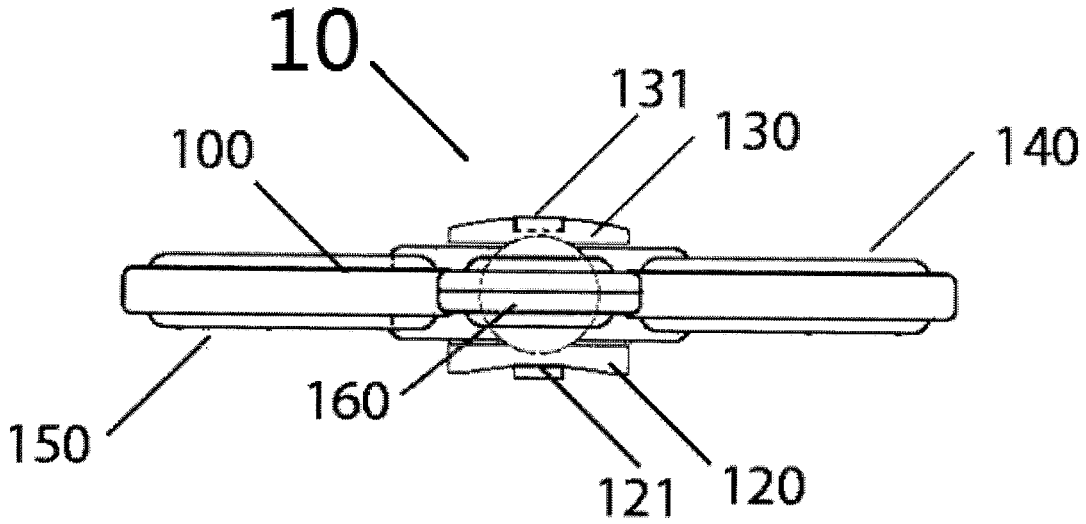
FIG. 3 is a side view of the spinning toy of the present invention.

FIGS. 1 to 3 show one embodiment of a spinning toy 10 of the present invention. The toy 10 includes a main body 100 which is made of light-weight materials, and includes a central part and blade parts. The said light-weight materials may be plastic, metal or alloy. In one embodiment, the plastic is ABS (Acrylonitrile Butadiene Styrene) engineering plastic.

The toy 10 includes a bearing 110 which may be made into different shapes as required, for example, its cross section being rectangular or circular. The bearing 110 is disposed in the center of the toy 10.

To seal the bearing 110 in order to facilitate operating the toy 10 with fingers, a first finger cover 120 and a second finger cover 130 are arranged on two sides of the bearing 110. The first finger cover 120 and the second finger cover 130 are buttoned on the bearing 110, for example, by way of connection using a rivet.

The toy 10 also includes weight modules, each of which is disposed on each blade to balance the weight of the spinning toy, wherein at least one weight module may move to adjust the twisting force to change the momentums of the blades. In the figures, the weight modules are marked by 140, 150 and 160, and are respectively disposed on three blade parts of the main body 100. The weight modules are all disposed at the end parts of the blade parts of the main body 100. To adjust counter-weight members, the position of one or multiple weight modules is adjustable. For example, as shown in FIG. 1, the weight module 160 may move between positions 161 and 162 to obtain different gravity center positions as required, wherein by pinching the first finger cover 120 and the second finger cover 130 with fingers, the user can hold the toy and suspend the main body between the fingers, and then slightly flicks the blades with the other hand to make the blades spin; and when the positions of the counter-weight members of the weighting modules are adjusted, as the gravity center is no longer evenly distributed, the user can make the blades spin for a long time by swinging the toy in a proper rhythm. This structure not only allows the spinning toy to spin for a long time, but also renders it possible for the user to adjust the spinning speed by swinging the toy in a proper rhythm.

According to one embodiment of the present invention, at least one blade part of the main body 100 includes a separable assembling piece 101 for fixing the weight modules at adjustable positions. In addition, after the assembling piece 101 is separated from the main body of the toy 10, the weight module may be replaced, and then the assembling piece 101 is recombined with the main body of the toy 10.

According to one embodiment of the present invention, the weight modules are spheres made of metal, and are arranged in the at least one blade part of the main body 100.

Figure 4:
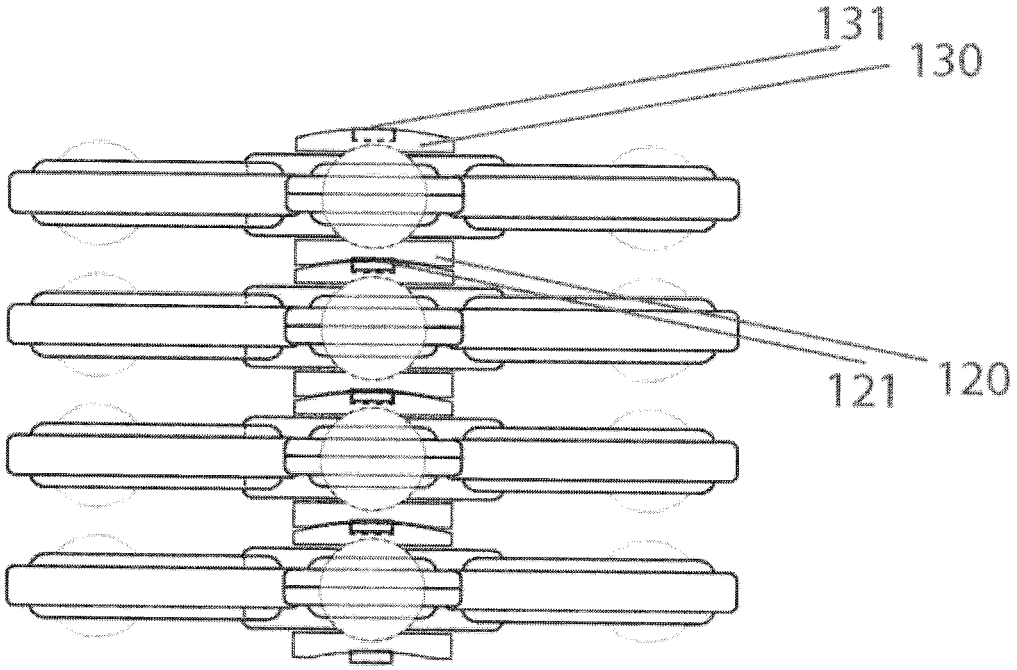
FIG. 4 is a schematic diagram of multiple stacked spinning toys of the present invention.
Figure 5:
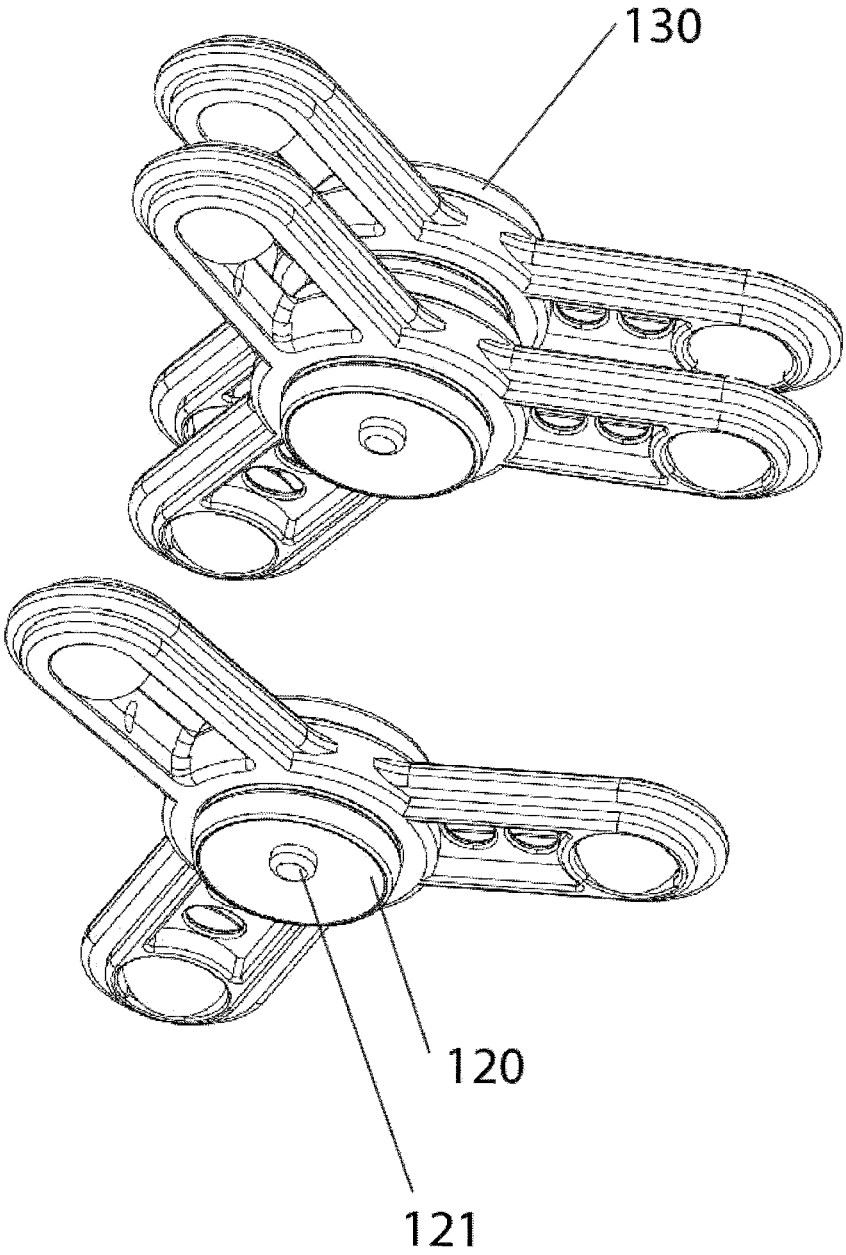
FIG. 5 is a side view of the multiple stacked spinning toys in FIG. 4.

To improve the playability and the interestingness of the toy 10 described herein, multiple toys 10 are stacked together. As shown in FIG. 4 and FIG. 5, the first finger covers 120 and the second finger covers 130 of the toys 10 are respectively provided with mutually combinable connection pieces 121 and 131; when there is a need of stacking the multiple toys 10, it only needs to combine the multiple toys 10. In one embodiment, the connection pieces are bulges and recesses.

To facilitate the use, the bulges and the recesses are in arc shapes.

In actual use, if a user intends to stack the multiple toys 10 and spin them together for a long time, it needs to adjust the weight module 160 of each toy 10 to the central position of the toy 10, rendering it possible for the user to increase the spinning speed and keep the toys 10 spinning together for a long time by swinging the toys 10 in a proper rhythm. It is a bigger challenge than keeping one toy 10 spinning for a long time.

Figure 6:
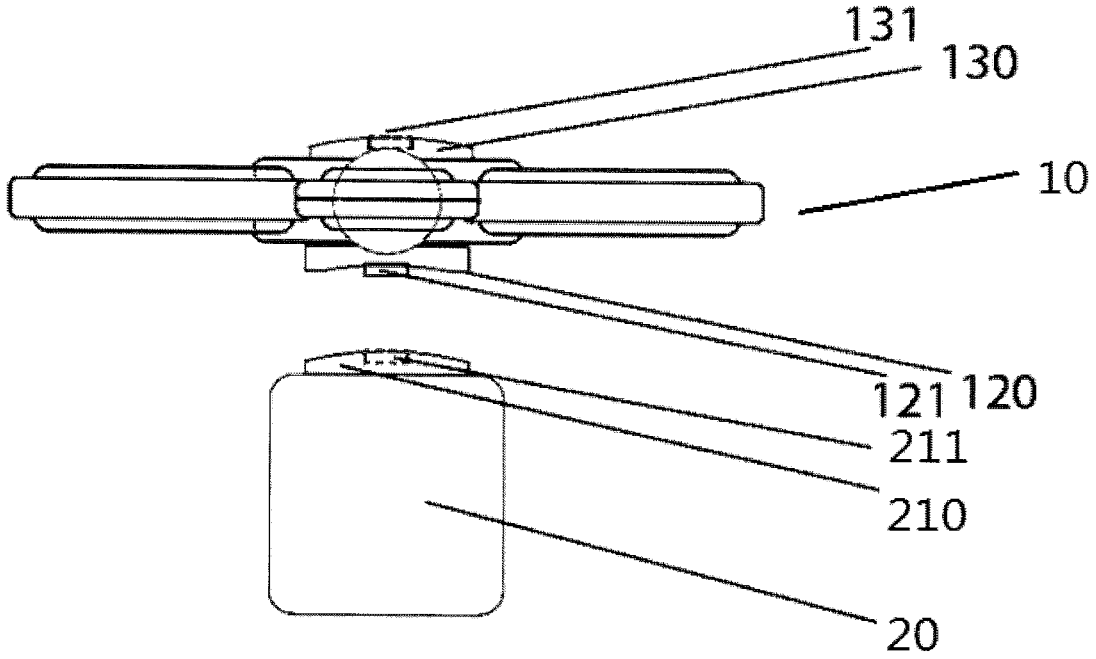
FIG. 6 is a decomposition schematic diagram of connection between a spinning toy of the present invention and a connection base.
Figure 7:
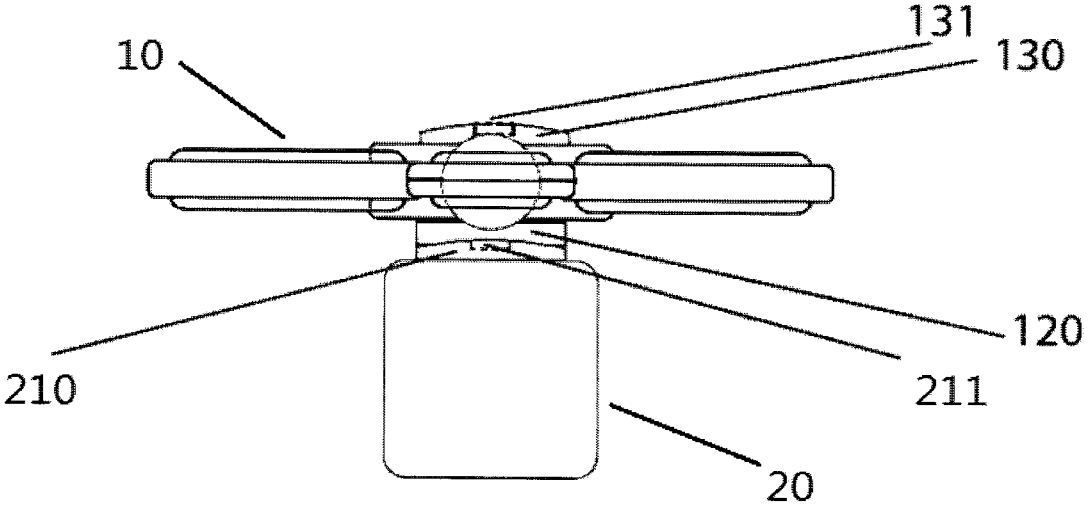
FIG. 7 is a schematic diagram of the spinning toy in connection with the base in FIG. 6.

In addition, as shown in FIG. 6 and FIG. 7, the toy 10 of the present invention may also be placed on any other objects, for example, on a cube seat 20. In that case, connection pieces 210 and 211 for connecting the toy 10 are disposed on the cube seat 20, and are matched with the connection pieces 120 and 121 of the toy 10. Preferably, the connection pieces include a bulge and a recess. To facilitate the use, the bulge and the recess are both in arc shapes.

In the present invention, the toy, through the adjustment of its balance weight in the conjunction with wagging actions, may spin for a long time at a proper rhythm, thereby improving its interestingness and playability.

Connection mechanisms further provided with the toy of the present invention may allow multiple toys to be stacked together or coordinate with and be connected to other devices to make the multiple toys spin independently, thereby improving the playability of the whole toy.

Finally, it should be noted that the above-mentioned descriptions are only preferred embodiments of the present invention, but not intended to limit the present invention. Persons skilled in the art can make various changes and modifications to the present invention, and any modifications, equivalent replacements and improvements that are made without departing from the spirit and principle of the present invention shall all fall within the scope of protection of the present invention.

The invention claimed is:

1. A spinning toy, comprising:

a main body, which is provided with blades, each of which can be provided with weight modules;

a bearing, which is disposed in a center of the main body;

an upper and bottom part of the bearing is provided with an upper finger cover and a bottom finger cover respectively; and weight modules, which are disposed on the blades to balance the weight of the spinning toy, wherein at least one weight module may move to render gravity centers of the blades unevenly distributed and, in conjunction with the spinning toy being swung in a proper rhythm, twisting forces being adjusted and thereby momentums of the blades being changed, causing the blades to spin for a long time.

2. The spinning toy according to claim 1, wherein the blades are provided with different fixing positions to fix the weight modules at different positions.

3. The spinning toy according to claim 1, wherein the blades can be disassembled and reassembled to replace the weight modules at will.

4. The spinning toy according to claim 2, wherein the blades can be disassembled and reassembled to replace the weight modules at will.

5. The spinning toy according to claim 1, wherein the weight modules are accessories having weights.

6. The spinning toy according to claim 5, wherein the accessories are metal balls.

7. The spinning toy according to claim 1, wherein the bearing is pre-disposed on the main body, and the upper and lower finger covers are buttoned on the bearing.

8. The spinning toy according to claim 1, wherein connection structures are disposed on the upper and lower finger covers to improve connectivity of the toy.

9. The spinning toy according to claim 8, wherein the connection structures are bulges or recesses disposed on the upper and lower finger covers.

10. The spinning toy according to claim 9, wherein the bulges and the recesses are in arc shapes to combine multiple toys together.

11. The spinning toy according to claim 8, wherein the connection structures are used for connecting other devices.

* * * * *